United States Patent [19]

Carlqvist

[11] Patent Number: 4,815,291

[45] Date of Patent: Mar. 28, 1989

[54] METHOD AND ARRANGEMENT IN HEAT ENGINES

[75] Inventor: Stig G. Carlqvist, Paris, France

[73] Assignee: Stig G. Carlqvist Motor Consultant (C.M.C.), Malmo, Sweden

[21] Appl. No.: 12,911

[22] PCT Filed: Apr. 21, 1986

[86] PCT No.: PCT/SE86/00182

§ 371 Date: Dec. 29, 1986

§ 102(e) Date: Dec. 29, 1986

[87] PCT Pub. No.: WO86/06439

PCT Pub. Date: Nov. 6, 1986

[30] Foreign Application Priority Data

Apr. 22, 1985 [SE] Sweden ..... 8501943

[51] Int. Cl.[4] ..... F02G 1/04

[52] U.S. Cl. ..... 60/520

[58] Field of Search ..... 60/518, 520

[56] References Cited

U.S. PATENT DOCUMENTS

| | | | |
|---|---|---|---|
| 3,552,120 | 3/1969 | Beale . | |
| 4,188,791 | 2/1980 | Mulder | 60/520 |
| 4,511,805 | 4/1985 | Boy-Marcotte et al. | 60/518 |
| 4,642,547 | 2/1987 | Redlich | 60/520 X |

FOREIGN PATENT DOCUMENTS

| | | |
|---|---|---|
| 0070780 | 1/1983 | European Pat. Off. . |
| 3242658 | 5/1984 | Fed. Rep. of Germany . |

*Primary Examiner*—Allen M. Ostrager

*Attorney, Agent, or Firm*—Beveridge, DeGrandi & Weilacher

[57] ABSTRACT

A heat engine has one or more reciprocating pistons, an effect-receiving device for directly receiving the useful effect from the piston or pistons without any intermediary rotating effect-transmitting mechanism, and a synchronizing device for synchonizing the movements of the piston or pistons with the thermodynamic cycle.

8 Claims, 3 Drawing Sheets

METHOD AND ARRANGEMENT IN HEAT ENGINES

The present invention relates to a method and an arrangement in heat engines, more particularly heat engines of the free-piston type intended for internal or external supply of heat by continuous or intermittent combustion or, as far as the external heat supply is concerned, by heat sources of the type heat accumulator, isotopic heat, solar power or the like.

Heat engines of the piston type may be divided, with regard to their utilisation of the mechanical effect generated, into on the one hand kinematic engines designed with crank and/or link operated mechanisms adapted to produce a mechanical effect on a shaft and, on the other hand, free-piston engines generating a useful effect in the form of a gaseous or hydraulic pressure, electric current or other form of energy directly by reciprocating piston movement.

The kinematic piston engines which today are the dominant piston type heat engines, are highly advantageous in that the power generating forces can be controlled in a relatively optimal manner, resulting in a favourable thermal efficiency and power density. This applies to both internal combustion engines of the Otto or Diesel type and to piston engines with external heat supply of the hot gas type with Stirling or Ericsson cycle, or of the Rankine type, regardless of whether heat is supplied by continuous or intermittent combustion, or in some other manner. The shortcomings of kinematic piston engines are well known and reside in the relatively high cost of the rotating mechanical power transmission, the necessity of a developed lubricating system with circulating lubricating oil, and the heavy friction losses reducing engine efficiency.

Free-piston engines therefore have been the subject of many inventions and improvements, but never have succeeded in finding a more extensive practical use. The difficulties encountered in developing free-piston type engines have largely been attributable to defective piston guide means, low useful effect and reduced reliability after the engine has been operating for some time when wear has changed the balance of the piston forces.

For this reason, it has so far not been possible to utilise to any greater extent the inherent simplicity of the free-piston engines which is due to the fact that the piston or pistons, operated by the pressure generating effect of the thermodynamic process, are able to generate directly, without the intermediary of any rotating mechanisms that may produce losses, a useful effect in the form of electric current, hydraulic power etc. Free-piston engine constructions therefore have been characterised so far by moderate efficiency, low power density, high cost per unit of power, vibrations during operation, and unreliability.

It therefore is the object of the present invention to design free-piston engines in such a manner that the advantages of simplicity, low production cost and robustness are maintained, while at the same time the advantages of an exact and practically optimal piston movement are achieved, whereby the good qualities of the kinematic piston engine can be realised.

To achieve this object, the useful effect from the piston is received directly, without the intermediary of crank-operated rotating mechanisms, in an effect-receiving device in the form of, for example, a linear electrical generator which is activated by the piston movement in a magnetic field within the cylinder or, inversely, the piston itself generates within the cylinder a movable magnetic field which activates electrical windings within the cylinder, such that an electric current is obtained. Alternatively, the piston itself may generate gas forces or hydraulic forces, or directly operate another piston generating gas or hydraulic forces in such a manner that a useful effect can be obtained from the reciprocating linear movement of the piston or pistons.

In one practical application, the working piston of the engine is connected directly with another piston or an armature in a linear electrical generator, the effect still being transmitted solely by a reciprocating movement and completely without conversion into a rotating movement, as in kinematic engines.

Thus, the large effect-producing forces in the engine are utilised directly and without intermediary rotating mechanisms to generate a useful effect, whereby simplicity and a high degree of efficiency are achieved. After a useful effect has been obtained and turned to account, the present invention uses a very small part of the available forces for:

- synchronising the movements of the piston or pistons with the thermodynamic cycle;
- balancing the mass forces of inertia of the piston or pistons;
- contributing to a specific exchange of forces between the pistons, conditioned by the thermodynamic cycle;
- operating, if necessary, auxiliary equipment needed for the total engine function, such as cooling water pump, combustion air fan, cooling fan, fuel pump etc. or/and valves in four-stroke engines with internal combustion;
- eliminating natural forces on the piston or pistons to make the pistons operate, from the viewpoints of friction and wear, as in a conventional free-piston engine, solely by means of simple and light-weight linkages.

Because these power requirements are very low in relation to the useful effect of the engine, the synchronising means can be made small and light and designed for low power demand. Since the forces transmitted also are small, a lubricating system with circulating lubricating oil may also be dispensed with, which is highly advantageous to energy consumption, but above all to the function of hot-gas engines with external heat supply which are very sensitive to oil contamination of the internal heat exchanger surfaces.

In multi-cylindrical hot-gas engines of the so-called double-acting type which is characterised by advantageously high power density and operates very smoothly and without vibrations, the synchronising device is used for giving the correct phase angle between the pistons. Such an embodiment is shown in FIGS. 2 and 3 of the drawings. The embodiments illustrated are characterised, in accordance with the invention, in that the reciprocating pistons of the engines produce, directly or by means of a direct-connected reciprocating device, a useful effect without the intermediary of a rotating shaft. The principles of the invention are applicable to different types of free-piston engines.

BRIEF DESCRIPTION OF THE DRAWING

Some characteristic applications of the invention are illustrated in FIGS. 1–3. FIG. 1 shows how a single-cylinder hot-gas engine 1 having two pistons 2, 3 operates in accordance with the so-called alpha principle. The heat source is a heater 4 with continuous combustion, and the power is generated in a hermetically sealed housing 5. Thus, the engine 1 is supplied with heat by an external heater 4 having a preheater. Air is supplied through an inlet 6 via a combustion air fan (not shown). The air is preheated in a heat exchanger 7 which preferably is of the countercurrent type. The preheated air enters into a combustion chamber 8 and is mixed with fuel from a nozzle 9 to provide a suitable fuel/air ratio. High temperature combustion gas is formed in the combustion chamber 8 and passes two rows of heater pipes 10 and 11, whereby the temperature of the combustion gas drops from about 1800° C. to about 800° C. The residual heat in the exhaust gases is utilised to preheat the incoming combustion air, and the gas temperature now drops to about 200° C. The gas is exhausted through an outlet 12. To start the engine 1, the fuel/air mixture in the combustion chamber 8 is ignited by a spark plug 13 which may be disconnected when the engine has started. The combustion chamber and the air preheater are thermally insulated by means of a layer 14 which in turn is enclosed in a casing 15. The heat absorbed by the heater is supplied to the enclosed working gas which may be, for example, hydrogen, helium or air under high pressure, for example 10–15 Mpa. During the working cycle, the gas is transferred from the hot expansion space above the upper piston or the displacement piston 2 to the cold compression space underneath the same piston. The heat is accumulated in a regenerator 16. Heat which is not converted into useful energy, is cooled off in a cooler 17 which in turn is cooled with water entering at an inlet 18 and exiting at an outlet 19. The temperature variation caused by the heating and cooling of the working gas gives rise to a pressure variation which sets the lower piston or the working piston 3 in motion. The working piston 3 is directly connected to an armature 20 in a linear electrical generator 21 having a soft-iron core 22 and a copper winding 23. The armature 20 has a set of permanent magnets which, upon movement of the armature, generate an electric current in the winding 23. In this manner, the useful effect of the engine 1 can be turned to account in the form of electric power without the intermediary of a rotating mechanism. This conversion of energy occurs within the hermetically sealed housing 5 in a manner which effectively prevents any leakage of working gas.

Figure 1:
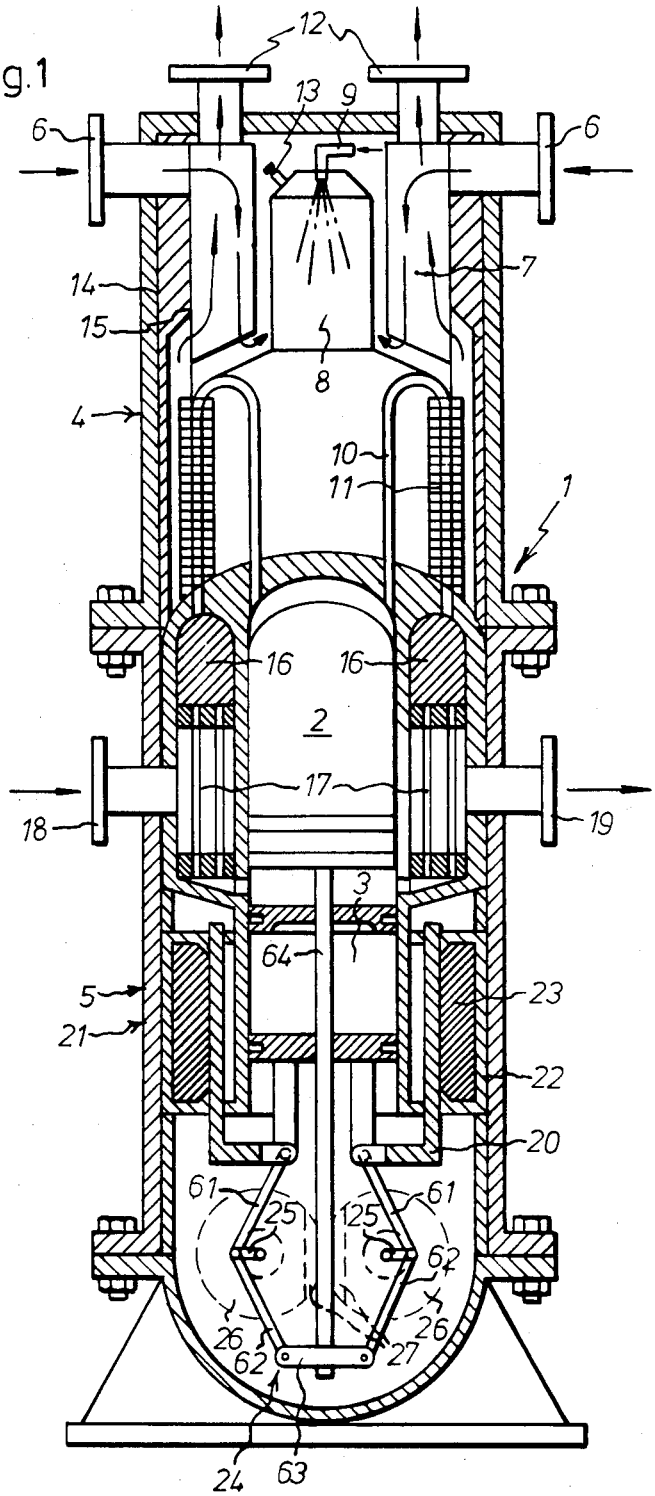
FIG. 1 is a first embodiment of the invention in which a single-cylinder hot-gas engine is shown with a first form of synchronizing means controlling the movements of pistons.

To synchronise the movements of the pistons 2, 3, such that an optimal phase angle may be maintained between the piston movements, the armature 20 of the generator 21 is connected with a synchronising device 24 which also controls the movement of the pistons 2, 3 so that no lateral forces against the cylinders can arise. For this reason, the pistons travel within the cylinders with a minimum of friction necessary to obtain minimum leakage past the pistons. Due to the low friction between the pistons and the cylinders and due to the small forces in the synchronising device, no lubricating system with circulating oil is needed, and this also obviates the risk of contamination of the heat exchanger transfer surfaces by lubricating oil. Since the two cranks 25 in the synchronising device 24 are rotated in opposite directions by means of plastic gears 26, the mass inertia of the pistons 2, 3 can be completely balanced by means of counterweights 27 on the periphery of the gears 26. The synchronising device 24 may be utilised for operating the auxiliary equipment of the engine 1, such as the fuel and water pumps (not described in this application). If desired, also the combustion air fan and the radiator fan can be operated by an outwardly sealed shaft. To completely avoid using an output shaft, these last-mentioned auxiliary means may be operated externally by means of electric motors. In this manner, the housing 5 will be completely and hermetically sealed. The type of synchronising device may vary depending on the design of the free-piston engine.

A mean pressure prevailing in the housing 5, the varying working pressure on the working piston 3 will contribute to making the working piston perform work during movement both into and out of the cylinder. This arrangement gives the same power density and thermal efficiency as a kinematic hot-gas engine, simulataneously as the working gas is hermetically sealed and oil contamination is prevented in the same manner as in a free-piston engine. A suitable name for this new engine form would be controlled free-piston engine or semifree-piston engine.

Figure 2:
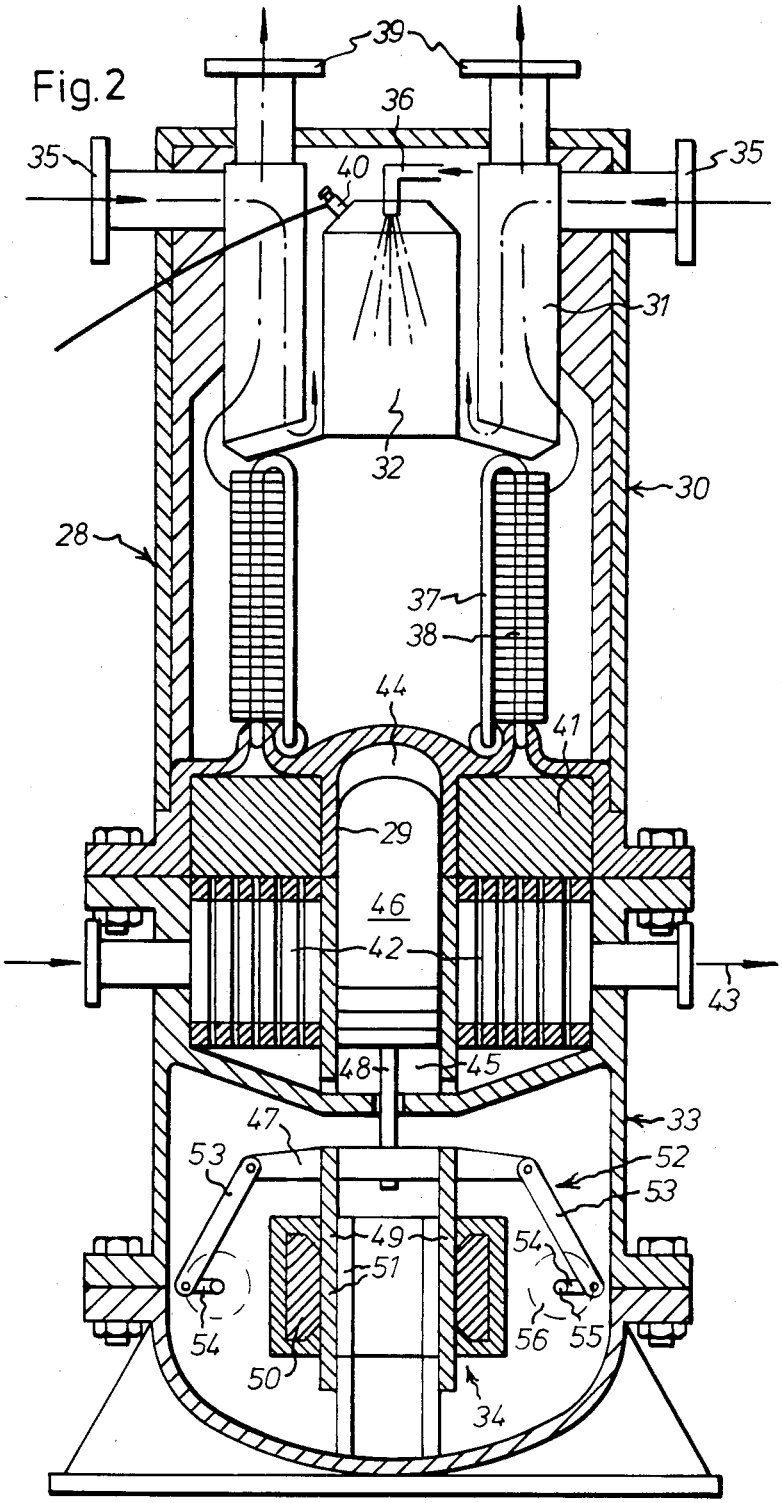
FIG. 2 is a second embodiment of the invention in which a four-cylinder hot-gas engine is shown with a second form of sychronizing means controlling the movements of the pistons.

A different embodiment is shown in FIG. 2 illustrating a double-acting hot-gas engine 28 with four cylinders 29. With this embodiment of the hot-gas engine, higher engine speeds and thus an even higher power density are obtainable as compared to the single-cylinder engine 1. Its application is, of course, best suited for effects exceeding a certain useful effect justifying the use of several cylinders. This example has been chosen to demonstrate the arrangement of a semifree-piston engine with four cylinders in line. In a valved Otto or Diesel engine, the valve mechanism is operated by camshafts connected to the synchronisation shafts with a gear ratio of 1:2.

FIG. 2 shows specifically a four-cylinder hot-gas engine 28 with external heat supply in the form of a heater 30, an air preheater 31 and a combustion chamber 32 as well as a hermetically sealed power generating element in the form of a housing 33 and with four linear electrical generators 34, one for each cylinder. The combustion air is introduced through an inlet 35 by means of a combustion air fan (not shown) and preheated in the air preheater 31, whereupon fuel is supplied through a fuel nozzle 36. Combustion occurs in the combustion chamber 32, and the hot gases are conducted through the heater in two stages, at 37 and 38. The residual heat is utilised in the air preheater 31, and the gases are discharged through outlets 39 of low temperature, about 200° C. When the engine 28 is started, the combustion chamber 32 is ignited by means of a spark plug 40.

The heat absorbed in the heater is supplied to a pressurised working gas, such as hydrogen, helium or air, enclosed in the power generating element. The major proportion of the heat is accumulated in a regenerator 41 before the heat is converted into pressure energy. The heat that cannot be converted, is cooled off in a cooler 42 by means of a cooling medium 43, such as water. The hot working gas is expanded at high temperature, about 650° C., in the hot volume 44 and compressed at low temperature, about 50°-70° C., in the cold volume 45. The pressure differential across the piston 46, which is obtained by temperature variation, results in a reciprocating force which is transferred to a yoke 47 via a piston rod 48, and to an armature 49 in the linear generator 34 which also comprises a copper winding 50 and a soft-iron circuit 51. The yoke 47 also operates a synchronising device 52 which, for each cylinder 29, comprises two connecting rods 53 and cranks 54 which, via synchronising shafts 55, are mechanically connected with the remaining cylinders, such that an optimal phase angle is obtained between the four thermodynamic engine cycles, as well as a synchronising gear 56 at one shaft end.

Figure 3:
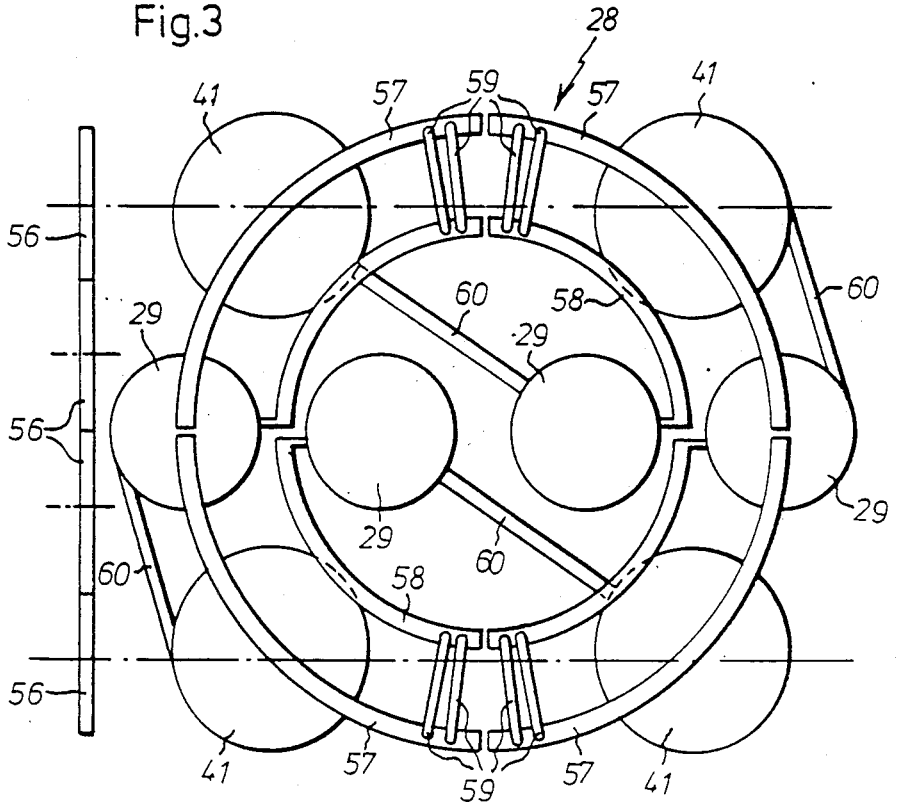
FIG. 3 shows schematically the typical lay-out for a four cylinder in-line hot-gas engine.

The application of the invention illustrated in FIG. 2 comprises cylinders 29, regenerators 41, coolers 42 and heaters 30 connected in the manner known for four-cylindrical in-line engines of the hot-gas type, as is schematically shown in FIG. 3. On the hot side, the cylinders 29 are connected to the regenerators 41 by collecting pipes 57 for the cylinders 29 and collecting pipes 58 for the regenerators 51. Between the four cylinder collecting pipes 57 and the four regenerating collecting pipes 58, heater pipes 59 are mounted in a ring. The cold connections between the coolers 42 and the cylinders 29 are designated 60. The shafts 55 which are characteristic of the present invention and which serve to synchronise the movements of the pistons 46, are interconnected by the gears 56, such that the synchronising shafts are counterrotated.

Although the invention has here been described with reference to topical applications, it may be similarly applied to other piston-type heat engines. As a matter of fact, since valves and auxiliary equipment may be driven, all kinematic type heat engines can be made to operate according to the semifree-piston principle characterising the present invention.

What is claimed:

1. A heat engine operating according to the Stirling or Ericsson thermodynamic cycle having external supply of heat and one or more cylinders which have reciprocating free-pistons located therein, said engine including an effect-receiving device for directly receiving the useful effect from the piston or pistons, a synchronizing means composed of simple light-weight linkages for synchronizing the movements of the piston or pistons with the thermodynamic cycle, said synchronizing means transmitting substantially no power from the engine and balancing the mass forces of inertia of the piston or pistons, providing a specific exchange of forces between the pistons conditioned by the thermodynamic cycle, and eliminating lateral forces on the piston or pistons to eliminate a need for a lubricating system with circulating lubricating oil.

2. A heat engine as claimed in claim 1 wherein the effect-receiving device is a linear electrical generator activated by the reciprocating movement of the piston or pistons in a magnetic field in the associated cylinder.

3. A heat engine as claimed in claim 1 wherein the effect-receiving device is a linear electrical generator wherein movement of the piston or pistons themselves generate a movable magnetic field, a cylinder in said engine containing electrical windings which lie in said movable magnetic field to generate an electric current.

4. A heat engine as claimed in claim 1 wherein the effect-receiving device is a linear electrical generator having an armature connected to a said piston.

5. A heat engine as claimed in claim 1 wherein the synchronizing device includes at least one connecting rod having one end connected to a said piston and another end connected to a crank.

6. A heat engine as claimed in claim 1 wherein the heat engine is a single cylinder hot-gas engine having a displacement piston and a working piston, said effect-receiving device being a linear electrical generator which has an armature, said working piston being connected with the armature of the electrical generator, said synchronizing means comprising two first connecting rods each having one end connected to the armature and another end connected to one crank, said cranks being rotatable in opposite directions by means of meshing gears, two second connecting rods each having one end connected to one of said cranks and another end connected to a crosspiece, said crosspiece being connected to a piston rod which is connected with the displacement piston.

7. A heat engine as claimed in claim 1 in which the heat engine is a multi-cylinder double-acting hot-gas engine, wherein each piston is connected by a piston rod and a cross-yoke to an armature of an electrical generator, said synchronizing means having two connecting rods associated with two respective pistons, said connecting rods each having one end connected to said cross-yoke and another end connected to a respective crank, said cranks being mechanically connected by synchronizing shafts to the cranks, connecting rods, cross-yokes and rods of all pistons in the engine; said cranks being rotatable in opposite directions by meshing gears which are mounted at the ends of said synchronizing shafts.

8. A heat engine as claimed in claim 1 characterized in that the effect-receiving device and the synchronizing means are enclosed in a hermetically sealed housing of the engine in order to effectively prevent leakage of any blow-by gases.

* * * * *